166-66 SR
4/27/82 XR 4,327,261

United States Patent [19]

Sheldon

[11] 4,327,261

[45] Apr. 27, 1982

[54] APPARATUS FOR SENSING A DISTENDED LOCATION ON A DRILL PIPE

[75] Inventor: Loren B. Sheldon, Houston, Tex.

[73] Assignee: BJ-Hughes Inc., Houston, Tex.

[21] Appl. No.: 3,035

[22] Filed: Jan. 12, 1979

Related U.S. Application Data

[63] Continuation of Ser. No. 777,673, Mar. 15, 1977, abandoned.

[51] Int. Cl.[3] ..... H01H 3/16; H01H 21/28; B25B 1/04

[52] U.S. Cl. ..... 200/61.41; 200/47; 294/104; 166/66

[58] Field of Search ..... 200/61.41, 61.42, 82 C, 200/47; 294/104; 166/66, 65 R, 250

[56] References Cited

U.S. PATENT DOCUMENTS 2,459,499 1/1949 Castel ..... 200/61.42
3,219,770 11/1965 Chasar ..... 200/47
3,546,954 12/1970 Ustin ..... 200/47 X
3,561,811 2/1971 Turner, Jr. ..... 294/104 X

FOREIGN PATENT DOCUMENTS 1449240 7/1966 France ..... 200/82 C

*Primary Examiner*—J. V. Truhe
*Assistant Examiner*—Richard M. Moose
*Attorney, Agent, or Firm*—Robert A. Felsman

[57] ABSTRACT

A method and apparatus for sensing a drill pipe joint is characterized by an arm pivotally moveable with respect to a drill pipe from a first, normal, position. The arm deflects a predetermined angular distance from the normal position when it comes into contact with a predetermined distended location on a drill pipe. An electrical signal is generated by a signal arrangement associated with the arm to indicate that the predetermined distended location is reached.

12 Claims, 3 Drawing Figures

Fig 2

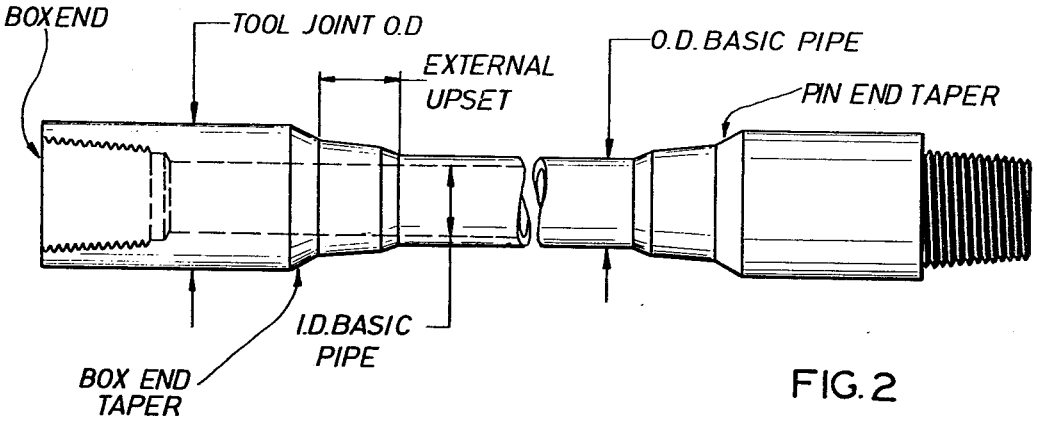
FIG. 2
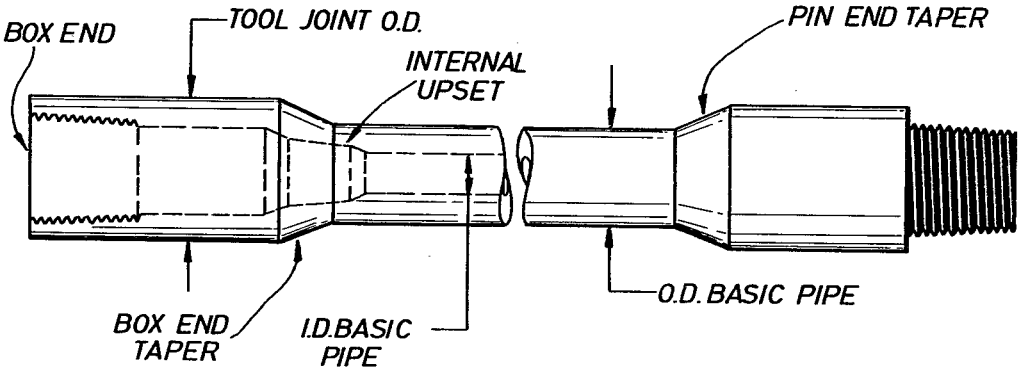

APPARATUS FOR SENSING A DISTENDED LOCATION ON A DRILL PIPE

This is a continuation of application, Ser. No. 777,673, filed Mar. 15, 1977, now abandoned.

CROSS REFERENCE TO RELATED APPLICATIONS

Subject matter disclosed and claimed herein is disclosed in the following applications, each assigned to the Assignee of the present invention:

U.S. Pat. No. 4,187,546, Computer-Controlled Oil Drilling Rig Having Drawworks Motor and Brake Control Arrangement, issued Feb. 5, 1980, in the names of the James P. Heffernan, Loren B. Sheldon, James R. Tomashek and Donald H. Ward; and, Power Tongs Control Arrangement, Ser. No. 777,926, filed Mar. 15, 1977 in the names of Loren B. Sheldon, James R. Tomashek and Donald H. Ward, now abandoned.

BACKGROUND OF THE INVENTION

1. Field of the Invention

This invention relates to a joint sensor for sensing the tool joint between pipe stands in a drill string.

2. Description of the Prior Art

Manually operable power tongs to effect the making and breaking of joints between elements of a drill string are known in the art. The tongs manual control console usually is provided with four levers, each of which controls a pilot valve of a small four-section stack valve. Each pilot valve controls one main function of the commonly utilized tongs structure.

For example, one valve controls the opening and closing of the backup tong. A second valve controls the tongs motor to rotate the power driven tong. The lift speed of the tongs is controlled by a third valve, while a fourth valve controls the upward or downward movement of the tongs lift. Of course, other tongs functions as, for example, the extension of the stabber (if one is provided) or the extension of a joint sensor would require a manual valve for the operation of each.

It would be advantageous to automatically control a power tongs arrangement by utilization of an electrical tongs control system. However, if an electrical control system is utilized, it is necessary to provide a suitable electro-hydraulic interface to permit valves which are manually operable to be operable in response to electrical signals output from the control system. Further, to locate the power driven and backup tong in a predetermined operating relationship with respect to the tool joint, a joint sensor arrangement is advantageously utilized.

SUMMARY OF THE INVENTION

This invention relates to a method and apparatus for sensing a distended location (such as a box end taper) on a drill pipe. The apparatus includes an arm having a roller thereon contactable with a drill pipe and pivotally moveable with respect thereto from a first, normal, position to a second, deflected, position. Further included are means associated with the arm for generating an electrical signal when the arm is deflected a predetermined angular amount by contact with the distended location. The method comprises the steps of relatively moving the arm with respect to the drill pipe with the arm contacted thereagainst to encounter a predetermined distended location thereon, and generating an electrical signal when the arm is deflected a predetermined angular amount by the encounter with the predetermined distended location.

BRIEF DESCRIPTION OF THE DRAWINGS

The invention will be more fully understood from the following detailed description thereof taken in connection with the accompanying drawings, which form a part of this specification, and in which.

DESCRIPTION OF THE PREFERRED EMBODIMENT

Figure 1A:
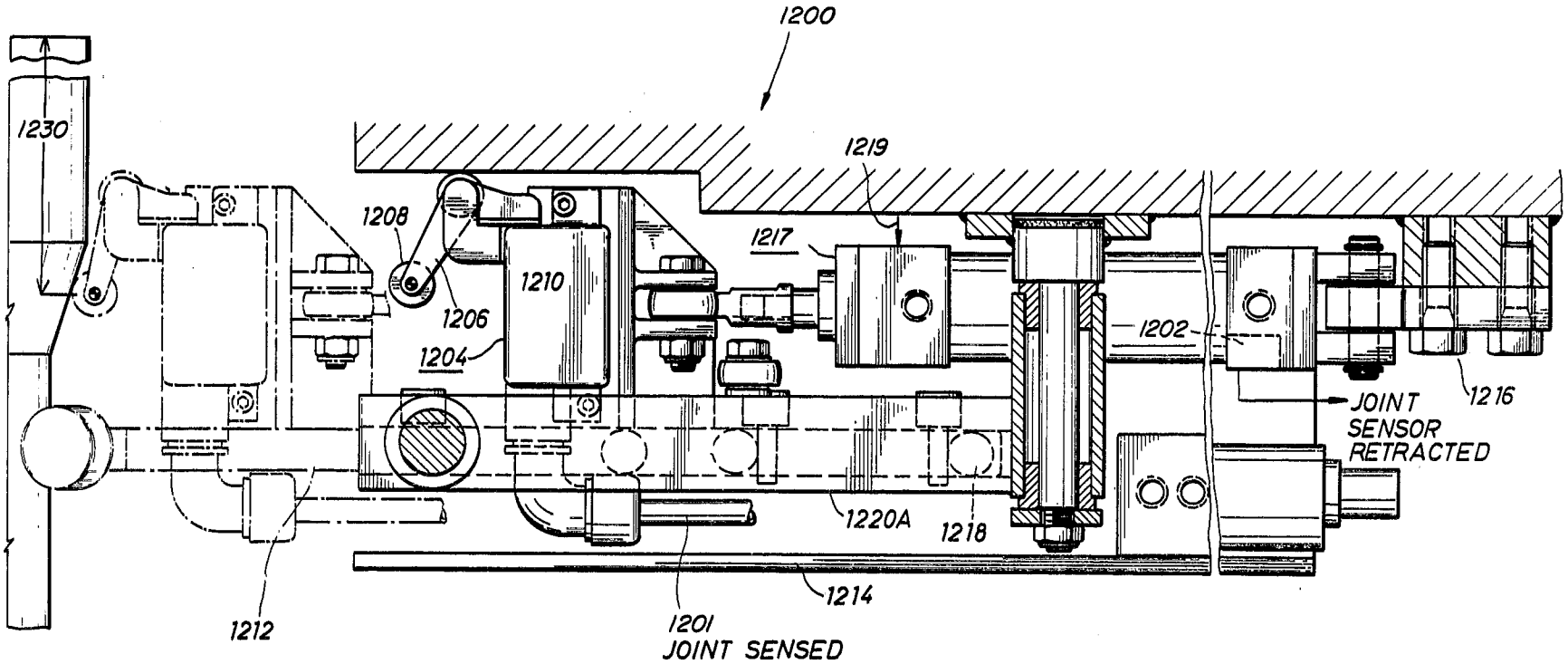
FIGS. 1A and 1B are, respectively, side and top views of a joint sensor embodying the teachings of this invention; and, FIG. 2 is a definitional diagram of two commonly utilized drill pipe sections.
Figure 1B:
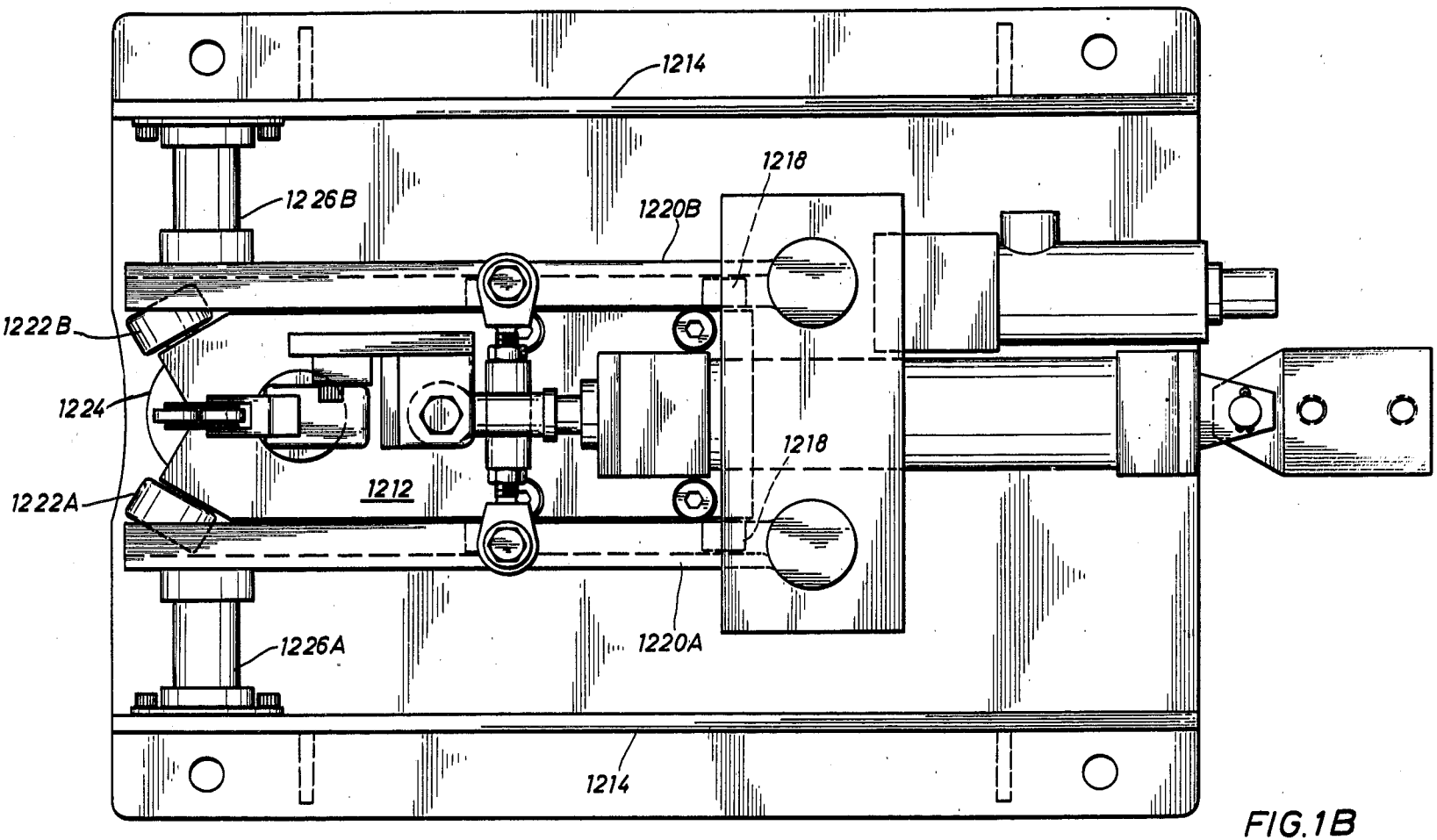

Throughout the following description, similar reference numerals refer to similar elements in all Figures of the drawings. Referring to FIGS. 1A and 1B, respectively shown are side and top views of a joint sensor generally indicated by reference numeral 1200 embodying the teachings of this invention. The joint sensor 1200 is attached beneath the backup tong of a power tongs assembly and is operative to accurately position the backup tong and a driven tong (not shown) in a symmetrical relationship with the tool joint being made-up or broken-out by the tongs under the control of a tongs control system. A suitable tongs control system is disclosed in each the above-referenced copending applications. Since the gripping space for the tongs dies is limited, and since considerable force must be applied to these dies, it is necessary to locate the backup tong and the driven tong as nearly as possible in vertical symmetry above and below a horizontal plane extending through the tool joint.

The joint sensor 1200 includes a sensor arrangement 1204 which comprises an arm 1206 having a roller 1208 thereon, the roller being contactable with a drill pipe and the arm being pivotally moveable with respect thereto from a first, normal, position to a second, deflected, position. The sensor arrangement 1204 also comprises means 1210, including a limit switch, associated with the arm 1206 for generating an electrical signal on an output line 1201 (JOINT SENSED) when the arm 1206 is pivotally deflected a predetermined angular distance from the normal position by being brought into contact with a distended location on the pipe. The arm 1206 is biased into the normal position by an internal spring assembly (not shown). The means 1210 may be any suitable commercially available assembly, such as that sold by Mirco under model number BZLN-2-RH.

In FIGS. 1A and 1B, the joint sensor arrangement 1204 of the sensor 1200 is mounted on a carriage 1212 disposed for movement within a suitable housing 1214. The housing 1214 is connectable by any suitable attachment arrangement 1216 to the underside of the backup tong. Disposed within the housing 1214 is a piston-cylinder arrangement 1217. The piston-cylinder arrangement 1217 is in fluid communication with a line 1219, illustrated diagrammatically in FIG. 1A, the line 1219 carrying a fluid, such as pressurized air, which when provided extends the joint sensor from a first, horizontally retracted, position to a second, horizontally extended, position. Included within the piston-cylinder 1217 is the limit switch which outputs an electrical signal on a line 1202 (JOINT SENSOR RETRACTED) to a tongs control system when the sensor 1204 is in the horizontally retracted position. The cylinder 1217 may provide a stroke greater than is necessary to extend the sensor 1204 to contact the pipe whose joint is to be sensed to provide an additional ability to follow any longitudinal misalignments of the pipe or irregularities in its surface, as with pipes exhibiting an external upset (FIG. 2). The pressure of the pressurized air in the line 1219 is sufficient to hold the extended sensor 1204 in position against the pipe. It is most advantageous to use a compressable fluid, as pressurized air, so that the pressurized air in the piston cylinder 1217 acts as a spring to allow movement of the sensor 1204 after it is extended.

The carriage 1212 has horizontal roller elements 1218 engageable with guide rails 1220 mounted within the housing 1214. The horizontal rollers 1218 are provided to facilitate the horizontal movement of the sensor 1204 and carriage 1212 thereof in response to actuation of the pistion-cylinder 1217.

In one embodiment of the invention, the carriage 1212 is provided with a pair of guide rollers 1222A and 1222B. As shown in FIG. 1B, the axes of rotation of each of the guide rollers 1222 define a predetermined angle 1224 of approximately 120 degrees therebetween. The angularity between the guide rollers 1222 assists in centering the sensor 1204 laterally with respect to the pipe. Centering springs 1226A and 1226B are also provided between the guide rails 1220 and the housing 1214 to permit the guide rollers 1222 to align the sensor 1204 with the pipe even though the pipe may not be centered within the tongs. In an alternate embodiment of this invention, the guide roller 1222 and the detector roller 1208 may each be of a predetermined lateral dimension and in a parallel relationship so as to be able to contact the pipe regardless of the centered orientation thereof with respect to the tongs. In such a structural embodiment, the carriage 1212 is moved horizontally from the retracted to the extended position by the piston-cylinder 1217 and lateral centering of the sensor 1204 on the pipe is not required.

In operation, the sensor roller 1208 moves with the tongs slowly upwardly until the arm 1206 is pivotally deflected from its normally outwardly biased position against the surface of the pipe by a distended surface feature on the pipe. With reference to FIG. 2, it is there shown that dependent upon the pipe utilized, any one of a predetermined number of distended portions on the pipe may be used to actuate the sensor arrangement embodying the teachings of this invention. The position of the box end taper (FIG. 2) having a predetermined diameter of approximately 5.70 inches when using 5.00 inch drill pipe is such a convenient location on the pipe. When the predetermined location on the pipe is encountered by the sensor roller 1208 and the arm 1206 is pivotally deflected from the normal position, the switch emits an electrical signal on the line 1201 that the joint has been sensed. When the predetermined location on the pipe is encountered, the distance 1230 from that location to the joint is a known value. The tongs lift is then stopped, the sensor is retracted, and the backup tong is locked.

Due to the standardization of drill pipes in the oil drilling industry, detection of a predetermined location, such as a predetermined diameter on the box end taper, insures that any other surface feature on the pipe, such as the joint itself, is then a predetermined known distance 1230 from the location which generated the deflection signal. Thus, it is insured that the tongs are in the operating position, that the backup tong and the driven tong are vertically symmetrical with respect to a horizontal plane through the pipe joint and that the joint may be made-up or broken-out by the tongs.

With reference to FIG. 2, shown are views of standard drill pipe stands having the commonly named portions thereof indicated as shown. Each end of each pipe stand illustrated has a distended joint portion thereon. One end of the stands includes a threaded male member while the opposite end thereof is an internally threaded female member. Normally, the pipe stand is inserted into the drill string such that the male end of each stand is inserted into the bore before the female end thereof. The male end of the next-to-be engaged stand is then connected by a power tongs to the female member of the last-inserted stand protruding from the bore.

Below the tool joint outer diameter, a taper portion known as the box end taper and the pin end taper, respectively, are provided on the female and male ends of the stands. Depending upon whether an internal or external upset is provided, further tapering of the drill pipe stand may occur. The difference between an internal and external upset pipe stand is illustrated in FIG. 2. Basically, an internally upset pipe presents a constant outer diameter between each of the end tapers while an externally upset pipe exhibits an upset taper on the exterior of the pipe stand. In order to accommodate either internally or externally pipe stands, the joint sensor 1200 embodying the teachings of this invention is operative to emit a signal when the roller 1208 and arm 1206 thereof comes into abutting contact with and is deflected by a predetermined location on the box taper. Of course, any predetermined location on the end taper sections, either on the internally or externally upset pipe stand, may be detected by a joint sensor 1200 embodying the teachings of this invention.

Having described a preferred embodiment of the invention, those skilled in the art may appreciate that modifications may be imparted thereto yet remain within the scope thereof as defined by the appended claims.

What is claimed is:

1. Apparatus for sensing a distended location on the exterior surface of a drill pipe comprising:

a sensor arrangement including an arm contactable with the exterior surface of a drill pipe and pivotally movable with respect thereto from a first, normal, position to a second, deflected, position;

means for positioning said sensor arrangement relative to said pipe exterior to dispose said arm in contact with the drill pipe; and means actuated by said arm in said second position for generating an electrical signal when said arm is deflected a predetermined angular amount from said normal position by a distended location of a predetermined diameter on a drill pipe.

2. Apparatus for sensing a distended location on a drill pipe comprising:

a housing;

a carriage movable with respect to said housing from a retracted to an extended position;

a sensor arrangement mounted on the carriage and movable therewith, the sensor arrangement including an arm contactable with the drill pipe and pivotally movable with respect thereto from a first, normal, position to a second, deflected, position;

means for moving the carriage from the retracted to the extended position to dispose the arm in contact with the drill pipe; and, means actuated by the arm in said second position for generating an electrical signal when the arm is deflected a predetermined angular amount from said first position by a distended location of a predetermined diameter on a drill pipe.

3. The apparatus according to claim 2 further comprising means for generating an electrical signal when the carriage moves from the retracted position.

4. The apparatus according to claim 2 wherein the means for moving the carriage comprises a cylinder mounted within the housing and a piston movably disposed within said cylinder in response to the introduction of a pressurized fluid thereinto, the piston being operatively associated with the carriage.

5. Apparatus according to claim 4 further comprising means disposed in operative association with the piston and cylinder for generating an electrical signal when the carriage moves from the retracted position.

6. Apparatus according to claim 2 further comprising means associated with the carriage for guiding the carriage along a drill pipe.

7. Apparatus according to claim 6 wherein said guiding means comprises a substantially Y-shaped member mounted to said carriage, each leg of the Y-shaped member having a guide roller disposed thereon, each guide roller simultaneously adapted to contact a drill pipe to center the sensor arrangement perpendicularly to the axis of the drill pipe.

8. Apparatus according to claim 7 wherein the angle defined between the first and the second legs of the Y is 120 degrees.

9. Apparatus according to claim 6 wherein the guide means comprises a roller member mounted to the carriage and adapted to contact a drill pipe when the carriage is in the extended position, the lateral dimension of the roller being greater than the lateral dimension of a drill pipe.

10. Apparatus according to claim 6 further comprising means for resiliently biasing the carriage with respect to the housing.

11. Apparatus for sensing a distended location on a drill pipe comprising:

a housing;

a carriage movable with respect to said housing from a retracted to an extended position;

a sensor arrangement mounted on the carriage and movable therewith, the sensor arrangement including an arm contactable with the drill pipe and pivotally movable with respect thereto from a first, normal, position to a second, deflected, position;

means for moving the carriage from the retracted to the extended position to dispose the arm in contact with the drill pipe;

means actuated by the arm in said second position for generating an electrical signal when the arm is deflected a predetermined angular amount from said first position by a distended location of a predetermined diameter on a drill pipe; and, means associated with the carriage for guiding the carriage along a drill pipe, wherein the guiding means comprises a substantially Y-shaped member mounted to said carriage, each leg of the Y-shaped member having a guide roller disposed thereon, each roller adapted to simultaneously contact a drill pipe to center the sensor arrangement perpendicularly to the axis of the drill pipe.

12. Apparatus for precisely locating the bevel of a box shoulder of a tool joint in which the distance between that bevel and a predetermined diameter on the box and elevator upset is a precise length, comprising:

means for sensing a diameter of predetermined size on the box end elevator upset of a tool joint;

means, actuated by said sensing means, for generating an electrical signal in response to the detection of such a predetermined diameter by said sensing means; and apparatus for positioning said sensing means adjacent the periphery of a pipe wall having a box end elevator upset therein comprising:

means for moving said sensing means in a first direction parallel to the axis of a length of pipe, means for moving said sensing means in a second direction perpendicular to the axis of a length of pipe, and means for contacting a length of pipe for guiding said sensing means for movement in a third direction perpendicular to the axis of a length of pipe.

* * * * *